US012007202B2

(12) United States Patent
Stern

(10) Patent No.: US 12,007,202 B2
(45) Date of Patent: Jun. 11, 2024

(54) MOUNTING DEVICE FOR WEAPON ACCESSORIES

(71) Applicant: GLOCK TECHNOLOGY GMBH, Ferlach (AT)

(72) Inventor: Thomas Stern, Neubau (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 133 days.

(21) Appl. No.: 17/995,674

(22) PCT Filed: Mar. 26, 2021

(86) PCT No.: PCT/EP2021/057901
§ 371 (c)(1),
(2) Date: Oct. 6, 2022

(87) PCT Pub. No.: WO2021/204565
PCT Pub. Date: Oct. 14, 2021

(65) Prior Publication Data

US 2023/0160664 A1 May 25, 2023

(30) Foreign Application Priority Data

Apr. 7, 2020 (EP) ..... 20168417

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS

| | | | |
|---|---|---|---|
| 6,185,854 | B1 | 2/2001 | Solinsky |
| 7,117,624 | B2 | 10/2006 | Kim |
| 8,127,484 | B2 | 3/2012 | Matthews |
| 9,551,550 | B2 | 1/2017 | Wells |
| 9,857,142 | B2 | 1/2018 | Sharron |
| 2011/0061283 | A1 | 3/2011 | Cavallo |
| 2016/0146572 | A1 | 5/2016 | Ley |

*Primary Examiner* — Jonathan C Weber
(74) *Attorney, Agent, or Firm* — Raven Patents, LLC; Anton E. Skaugset

(57) ABSTRACT

Mounting device for accessories of a firearm, and accessories with such integrated mounting devices, the firearm having guide elements with a recess, where the mounting device has at least one bearing knob and at least one locking spindle configured to cooperate with the bearing knob and the at least one recess. The at least one locking spindle has a selector knob with a resting protrusion, a connection piece and a center part on which at least one locking protrusion is formed. The locking spindle is rotatably and/or longitudinally displaceable in the device housing and is arranged to interact with the bearing knob and the spring.

16 Claims, 10 Drawing Sheets

MOUNTING DEVICE FOR WEAPON ACCESSORIES

TECHNICAL FIELD

The present disclosure relates to a mounting device for the temporary coupling of accessories to a firearm and to accessories having such an integrally formed mounting device.

BACKGROUND

Accessories for firearms in the context of this application are understood to mean any piece of equipment that is to be temporarily connected to the weapon and also to be detached. These can be laser sights, illuminated dot reticles, range finders, or light sources of any kind. Telescopic sights, IR aiming devices and the like are also to be considered for the purposes of the present disclosure. In principle, however, such a mounting device is also conceivable for mounting on objects other than firearms, such as vehicles, and should therefore be also read in this sense by a person skilled in the art.

For the assembly of such mounting devices on the firearm, at least one guide element is required which has a longitudinal extension and which has at least one recess transverse to its longitudinal extension. Such guide elements can be, for example, different rails, such as the bottom rail of GLOCK® pistols, or rails attached to the side or top of the receiver. In particular, the widely used Picatinny rails according to MILSPEC are suitable for the purposes of the present disclosure.

Heretofore, a number of possibilities for attaching accessories to rail systems of weapons have been known to a person skilled in the art. U.S. Pat. Nos. 7,117,624 B2, 8,127,484 B2, 9,551,550 B2, or 9,857,142 B2 are mentioned as examples. The content of these publications is incorporated into the content of the present application for the jurisdictions in which this is possible. When reading these publications, it quickly becomes clear to a person skilled in the art that more or less complicated clamping devices are required for attaching accessories, for example tactical lights or telescopic sights.

From U.S. Pat. No. 7,117,624 B2 a guide device that can be screwed to the housing of the accessory is known which has a rigid extension in the longitudinal direction for fixing the accessory to a guide element and engages in a recess of the guide element, for example a transverse groove of the guide element on a GLOCK pistol.

U.S. Pat. No. 9,857,142 B2 proposes an alternative mounting device which can be "swiveled" onto a Picatinny rail and fixed to a recess provided there by means of an extension. This mounting device has a further Picatinny rail for fixing an accessory on the outside.

In U.S. Pat. No. 8,127,484 B2 a relatively easy-to-use clamping device is proposed, by means of which accessory parts can be fixed to a guide element of a weapon, in particular a Picatinny rail. Due to the eccentric arrangement of the clamping piece, a strong compression can be achieved by means of a lever.

Furthermore, U.S. Pat. No. 9,551,550 B2 describes a mounting device integrated into a housing of an accessory part in which two wedge elements can be moved toward one another by means of a screw connection. As a result, the wedge elements slide along inclined guides in the housing, and a crosspiece is brought into engagement with a recess in a guide element of the weapon.

US2011/0061283 A1 discloses the use of a swiveling part which is oriented transvers to the barrel axis and under the load of a spring, in an embodiment turned by 90° and symmetrical to the median plane of the weapon; in both embodiments, the very blocking element is held by force only and therefore, in view of the dynamic forces, not fixed reliable.

U.S. Pat. No. 6,185,854 B1 discloses a similar device, using a leaf spring, which is in danger to get lost, and, as may be seen in FIG. 6, is hardly in a position to achieve reproducible positions, since a ramp is provided in order to make the mounting easier and to avoid the loss, but does not achieve a robust mounting.

US2016/0146572 A1 discloses the use of a spring-loaded screwing device, which may be used by hand; the spring should avoid unfastening, which, in view of the dynamic forces makes it necessary to fasten the device remarkably, which is, despite the size of the knob of the screw hardly possible. Additionally, there is the problem of contamination on the one hand and jamming of the screw mechanism on the other hand.

The previously known mounting devices are of different complexity in construction and require a plurality of components. In addition, levers require a certain amount of space, while screw heads can only be operated without tools starting at a certain size or shape, which makes them suitable for the designs of such mounting devices only under certain conditions.

The object of the present disclosure is to overcome the known aforementioned disadvantages in the prior art and to provide a mounting device which is compact and space-saving. In addition, it is an object of the present disclosure to allow operation that is as simple as possible and can be operated without tools and, moreover, to reduce the risk of unintentional opening, at least in one embodiment. Furthermore, it is an object of the present disclosure to support the locking process, in at least one embodiment, and in a further development even to promote self-locking of the mounting device.

In the explanation of the disclosed mounting device, the plurality of interacting elements is only occasionally mentioned below for the sake of brevity in order to facilitate readability. The same applies to the plurality of components that act analogously, for example when the locking spindle is doubled. However, it becomes apparent in the context of the disclosure, both of the description and of the figures; that a multiplication of the elements provided according to the present disclosure inevitably falls within the disclosure of this description.

A mounting device according to the present disclosure leads to the achievement of the aforementioned objects.

SUMMARY

The present disclosure is directed to mounting devices for the temporary coupling of accessories to a firearm, and accessories including such a mounting device.

In one example, the mounting device according to the present disclosure includes a device housing having guides configured to interact with guide elements of the firearm, a spring; at least one bearing knob; at least one locking spindle having a spindle axis, the locking spindle being configured to interact with the bearing knob and the recess; the locking spindle having a first end, a center part, and a second end; where the first end includes a selector knob with a resting protrusion, the center part has at least one locking protrusion formed in a spatial direction normal to the spindle axis, and the second end includes a connection piece; and the locking spindle is disposed in the device housing so that the locking spindle is rotatably and/or longitudinally displaceable. The mounting device is configured so that it can be placed in an open position by a displacement of at least the resting protrusion of the selector knob along the spindle axis, bringing the resting protrusion out of engagement with a detent formed on a side of the device housing, where the detent is complementary in shape to the resting protrusion, thereby enabling a rotation of the locking spindle; the rotation of the locking spindle can disengage the locking protrusion from the recess, thereby enabling a displacement of the mounting device along the guide elements; and the mounting device can be mounted on the firearm in a locking position by bringing the locking protrusion into engagement with the recess and engaging at least the resting protrusion of the selector knob partially or completely with the detent, thereby locking the mounting device in place.

BRIEF DESCRIPTION OF THE DRAWINGS

FIG. 4A is a schematic view of the mounting device with the locking spindle shown in various positions; FIG. 4B shows corresponding cross-section views along B-B' of FIG. 4A; FIG. 4C shows a vertical sectional view along C-C' of FIG. 2A.

FIG. 5A is a schematic view of the mounting device with the locking spindle shown in various positions; FIG. 5B shows corresponding cross-section views along B-B' of FIG. 5A; FIG. 5C shows a vertical sectional view along C-C' of FIG. 2A.

FIG. 6A is a schematic view of the mounting device with the locking spindle shown in various positions; FIG. 6B shows corresponding cross-section views along B-B' of FIG. 6A; FIG. 6C shows a vertical sectional view along D-D' of FIG. 2B.

FIG. 7A is a schematic view of the mounting device with the locking spindle shown in various positions; FIG. 7B shows corresponding cross-section views along B-B' of FIG. 7A; FIG. 7C shows a vertical sectional view along D-D' of FIG. 2B.

FIG. 10A is a schematic view of the mounting device with the locking spindles shown in various positions; FIG. 10B shows corresponding cross-section views along B-B' of FIG. 10A; FIG. 10C shows the two locking spindles having opposing directions of rotation.

DETAILED DESCRIPTION

Figure 1A:
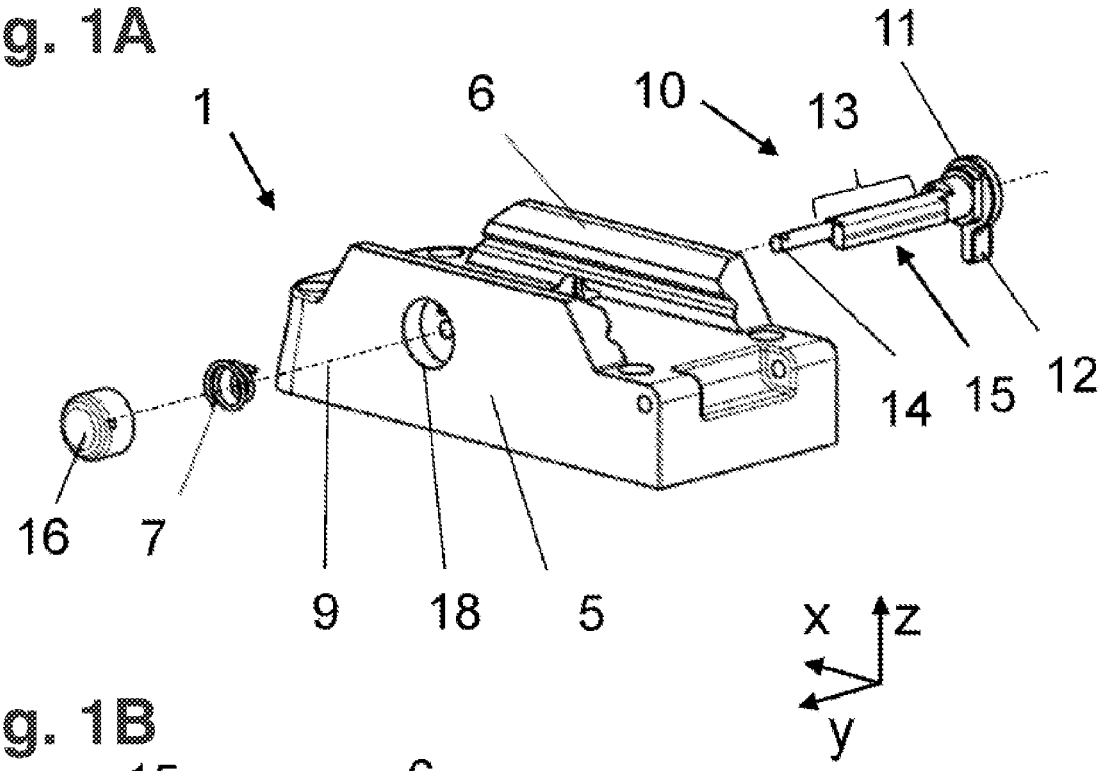
FIG. 1A is a simplified exploded view of a mounting device according to the present disclosure.

The terms left, right, top, bottom, front and rear always refer to the shooter's view in the firing direction of the firearm when it is held ready to fire. The weapon has, going through the barrel axis and oriented vertically, a weapon center plane, which, cum grano salis, forms a plane of symmetry.

A mounting device according to the present disclosure can include a locking spindle having at least one locking protrusion is rotatably and displaceably mounted in a housing of the mounting device such that in a locking position the locking protrusion contacts a guide element of a firearm in the region of a recess and in the open position is disengaged from the recess. At a first end, the locking spindle has a selector knob at which a resting protrusion protrudes. At a second end of the locking spindle, a connection piece is provided to be connected to a bearing knob. The locking spindle can be pretensioned in the direction of the bearing knob by means of a spring.

During handling, the bearing knob is first actuated in order to move the locking spindle slightly along the spindle axis. The selector knob is thus also deflected relative to the device housing, and the locking spindle can rotate into the open position. On the device housing, one or more detents are provided in the region of the selector knob and provide a latching position of the resting protrusion—that is, essentially a defined end position by which an angular position of the locking spindle is defined. The resting protrusion is brought out of its latching position by the relative movement of the locking spindle. The detent on the device housing is preferably designed to be complementary in shape to the resting protrusion.

In the release position thus defined, the locking protrusion can be brought out of engagement with a corresponding recess in the weapon-side guide element by rotation of the locking spindle. In this open position, the mounting device can be displaced along the guides or guide elements of the weapon. To attach the mounting device to the firearm, it is necessary to assume the locking position in reverse order, that is, by bringing the locking protrusion into engagement with a recess. The pretensioning of the latching knob results in a spring-loaded locking of the resting protrusion by partial or complete countersinking in the detent of the device housing.

The housing of the mounting device has guides which allow longitudinal guidance, especially laterally, along guide elements of a firearm. Preferably, these guides also offer an additional support surface in the vertical direction, that is to say "upward" and/or "downward" when viewed from the weapon, via a profile that is complementary in shape to the guide element. This can also be achieved with a T-profile, as well as preferably when Picatinny rails are used.

According to the present disclosure, there is a relatively good lateral and normal guidance of the accessory in the event of a longitudinal displacement on the guide element of the weapon. The guide is preferably designed as guide rails, wherein these guide rails do not have to be continuous in the longitudinal direction. In addition, turning the locking protrusion makes it possible for the mounting device—and thus the accessory—to contact and, where necessary, also clamp on the weapon. By suitably designing the shape, number and tolerances of the locking spindle or spindles and their locking protrusions, a person skilled in the art can achieve a very quick and easy-to-perform coupling of the accessories on the weapon. The relatively compact design is helped by the small number of components and their interaction according to the present disclosure. This also allows a cost-optimized production of high-quality components with low weight.

A further advantage of the mounting devices of the present disclosure is the possibility of having the locking position assumed largely automatically by the spring pretensioning. This "self-locking effect" benefits the user during routine assembly after a change of accessories, but especially in stressful situations.

For the implementation of the present disclosure and its more detailed explanation, reference is made to the drawings and the following description, in which a number of embodiments are explained in more detail. A person skilled in the art will also find further suggestions for various modifications of the mounting device of the disclosure, such as a two-sided clamping in the longitudinal direction, a double or multiple design of the locking spindle, and various modifications of the locking and latching elements.

The present disclosure extends to any type of accessory, such as a tactical light, a red dot sight, or the like, which have such a mounting device integrated.

Furthermore, the disclosed mounting device can also be used as an adapter for accessory parts with an alternative mounting device, or as a spacer. This can be used, for example, when a telescopic sight is mounted on an adapter, which can be mounted on the weapon relatively quickly and with repeatability by means of the proposed mounting device.

Figure 1B:
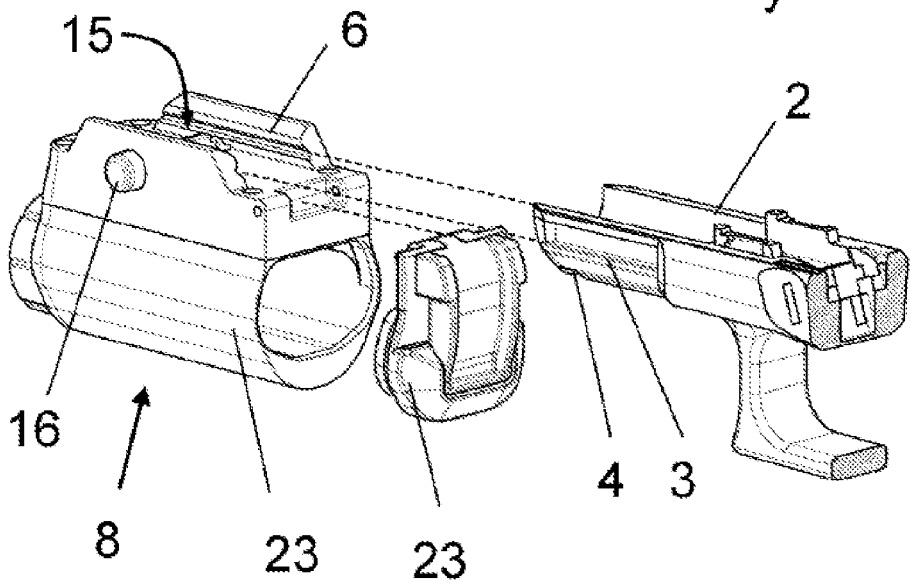
FIG. 1B shows a mounting device according to FIG. 1A mounted on an accessory.

FIG. 1 schematically shows a mounting device 1 (FIG. 1A), as well as the mounting device 1 mounted on an accessory 8 (FIG. 1B) in an exploded view; the direction of the running axis is inserted parallel to the x-direction of the drawn coordinate system. The guide 6 also runs in this direction.

In FIG. 1A it can be clearly seen that the locking spindle 10 can be introduced into the device housing 5 along the spindle axis 9 and can be connected to the bearing knob 16 on the connection piece 14. The connection piece 14 can be designed with the bearing knob 16, for example, as a detachable screw connection or plug-in connection, or also as a non-detachable plug-in connection. The locking spindle 10 is preferably secured against unintentional loosening on the connection piece 14 by means of a spring ring or, as can be seen in FIG. 1A, by means of a pin or spring pin. An equally suitable, albeit non-detachable, plug-in connection is indicated by way of example in FIG. 9B. The spring 7 serves to pretension the locking spindle 10 in the installed state in the direction of the bearing knob 16 and thus pulls the selector knob 11 essentially in the direction of the locking position.

As shown, the spring 7 is preferably arranged between the device housing 5 and the bearing knob 16, although alternative arrangements are also conceivable. The spring 7 can be designed as a coil spring, preferably as a conical spring. The bearing knob 16 can under certain circumstances be designed to be hollow in order to accommodate the spring 7 and thus save space.

The selected illustrations all have mounting devices 1 designed to be particularly space-saving. It is advantageous that the spring 7, as well as parts of the bearing knob 16; are at least partially accommodated within the device housing 5 by having a bearing recess 18. Opposite this, a selector recess 19 (FIG. 5B) for at least partial accommodation of the selector knob 11 can be formed on the device housing 5. As a result of these measures, the bearing and/or selector knobs 11 can be countersunk in a targeted manner relative to the surroundings and accordingly reduce the overall dimensions of the mounting device 1 or the firearm.

The locking spindle 10 has a plurality of portions and can be constructed in several parts or, preferably, in one part. A selector knob 11 which has a resting protrusion 12 in at least one spatial direction is formed at the first end. A plurality of latching projections can also be formed, or for example a star-shaped selector knob 11. The locking spindle 10 has the connection piece 14 described above at the second end. In between, a center portion or center part 13 is formed, from which at least one locking protrusion 15 is formed projecting in at least one spatial direction. In the embodiment in FIG. 1A, the locking protrusion 15, is formed normal to the direction of the resting protrusion 12 when viewed in the circumferential direction of the axis of the locking spindle. The selector knob 11 can under certain circumstances have a plurality of steps toward the center part 13 in order to achieve an improved support or bracing in the selector recess 19 (FIG. 5B).

The device housing 5 has one or more openings which run normal to the guide 6 in the transverse direction, that is to say the y-direction in the selected illustration. The guide 6 is designed to interact with the guide elements 3 of a firearm or another object. This can be seen very clearly from FIG. 1B, in which the front portion of a receiver 2 and a tactical light 8 with a mounting device 1 can be seen. The receiver 2 has guide elements 3 with a recess 4 on its underside. The accessory 8 can be pushed onto the receiver 2 by longitudinally shifting the mounting device 1 along the dashed lines and fastened by turning the selector knob 11, as will be explained in more detail later.

Furthermore, it can be seen from FIG. 1 that the mounting device 1 has a plurality of openings (see the corners of the device housing 5) in order to be screwed to an accessory 8, for example.

Figure 2A:
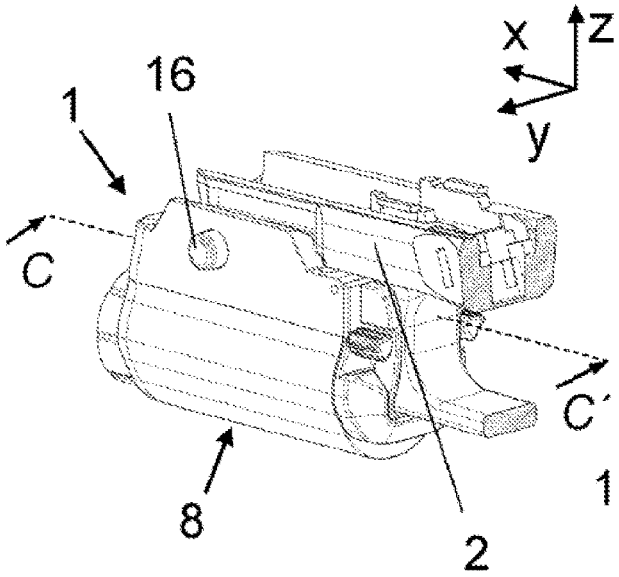
FIG. 2A is a schematic oblique view of an illustrative mounting device mounted on a receiver of a pistol.
Figure 2B:
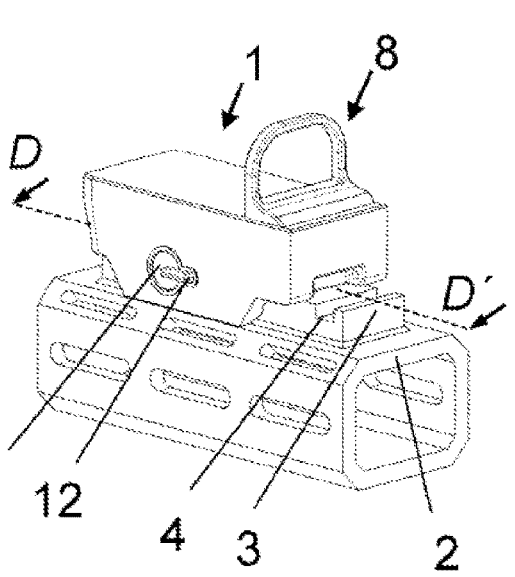
FIG. 2B shows an accessory with an integrally formed mounting device according to the present disclosure mounted on the receiver of a rifle.

In FIG. 2, schematic representations of assembled mounting devices 1 can be seen, the mounting device 1 being screwed to the accessory 8 in FIG. 2A or being formed integrally with the accessory 8 in FIG. 2B. In FIG. 2A, a tactical light, for example, is attached to a receiver 2, while a red dot or luminous point sight is shown as an accessory 8 in FIG. 2B. Furthermore, it can be clearly seen in FIG. 2B that the mounting device 1 is also very suitable for guide elements 3 of long guns (e.g. rifles). With the receiver 2, the illustration corresponds to a simplified section through a fore-end profile of an automatic rifle and, as the guide element 3, represents a greatly simplified guide rail with a plurality of recesses 4.

Guides 6 (FIG. 1) are formed in order to ensure a lateral support of the mounting device 1 on the firearm. Particularly preferably, the guides 6 are matched to the guide elements 3 in accordance with their cross-sectional shape and are thus designed to be complementary in shape. It is left to a person skilled in the art to design the shape and position tolerances accordingly in order to achieve the desired fit; this is also known for guides in the prior art and therefore does not pose a problem with knowledge of the present disclosure.

Figure 3A:
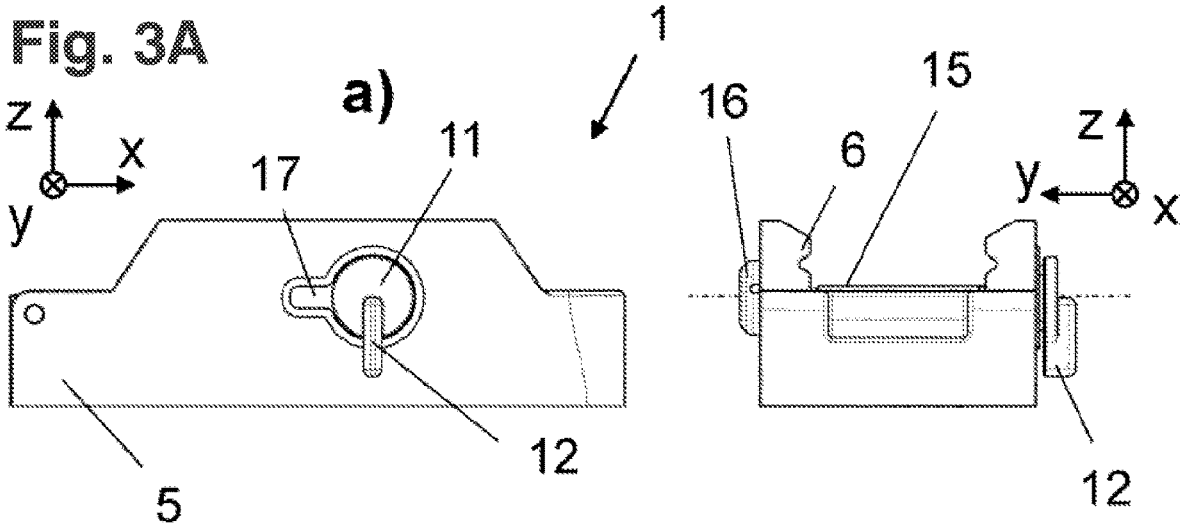
FIG. 3A is a schematic view of a mounting device according to the present disclosure in the unlocked position.
Figure 3B:
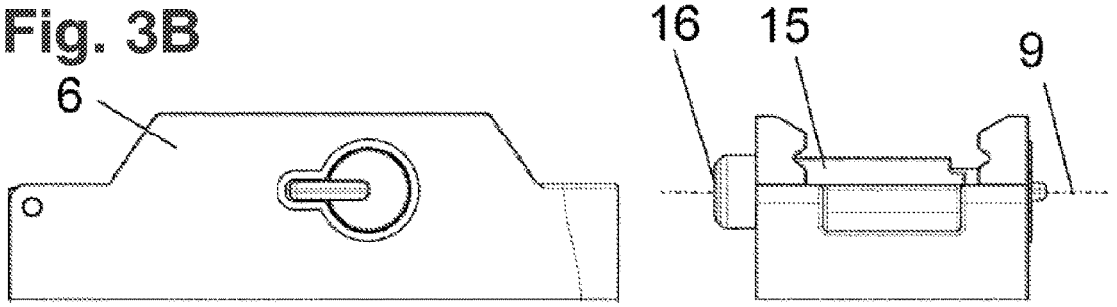
FIG. 3B shows the mounting device according to FIG. 3A in the locking position.
Figure 11A:
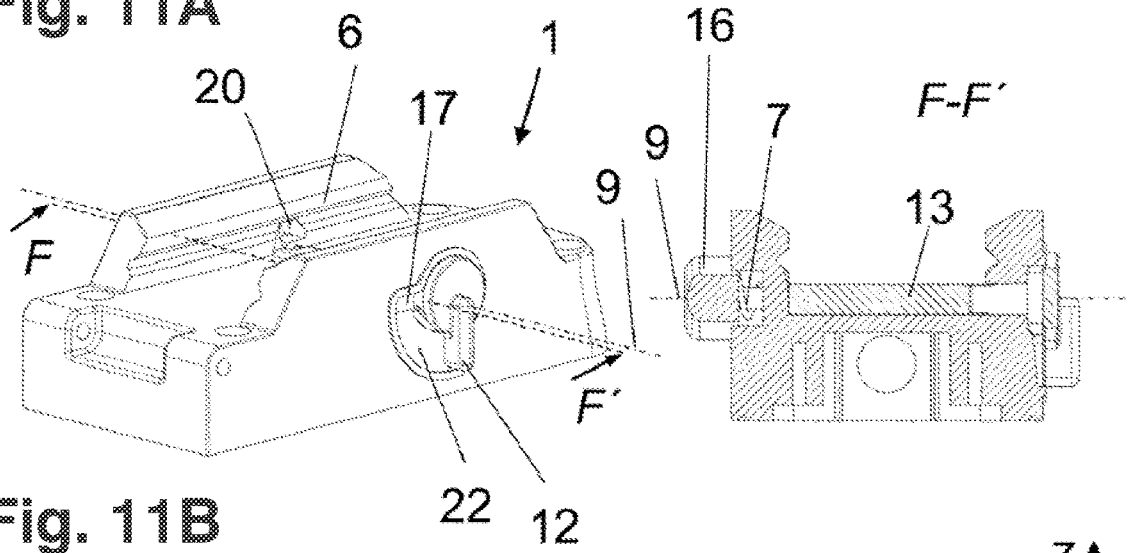
FIGS. 11A and 11B show purely schematically a mounting device according to the present disclosure having tapers in oblique views and in section, in the unlocked position and the locked position.
Figure 11B:
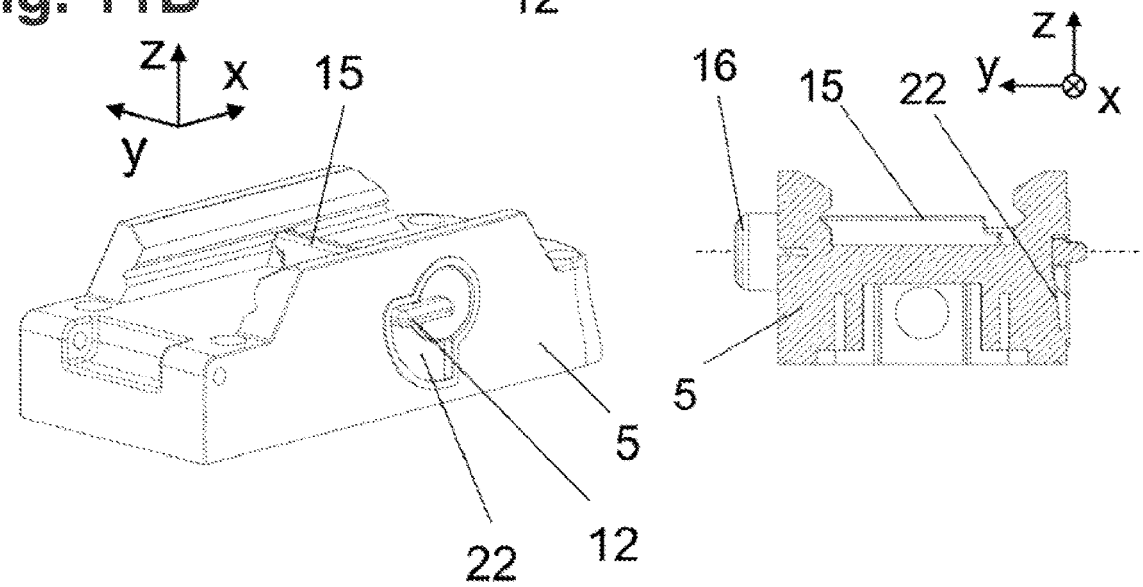

FIG. 3 is a schematic representation of an exemplary mounting device 1 in a side view (left row of images) and in a rear view (right row of images). In this case, the open position can be seen in FIG. 3A—that is, for the longitudinal adjustment of the mounting device 1 along the guides 6—and the locking position in FIG. 3B. Here, when viewed together with the other figures, the mounting principle according to the present disclosure becomes clear. In FIG. 3A, the selector knob 11 is pushed out of the device housing 5 in the y-direction by actuation of the bearing knob 16 and the resting protrusion 12 is rotated downward, whereby the locking protrusion 15 is "pivoted in" within a recess 27 of the device housing 5. In this way, the locking protrusion 15 is brought out of engagement with the recess 4 of a receiver 2 or another object and in this position no longer protrudes or only slightly protrudes over the surface of the device housing 5, as shown particularly well in FIG. 3A on the right (or else FIG. 11A). This makes possible a longitudinal displacement of the mounting device 1 along guide elements 3 (FIG. 1B). As a result of the connection forms mentioned above, the locking spindle 10 in the installed state is therefore mounted so that it can be displaced and/or rotated within limits inside the device housing 5.

If the resting protrusion 12 is rotated in such a way that it fits into the detent 17, the locking protrusion 15 is also "pivoted out" of the recess 27 (see, for example, FIGS. 4-7, 11) and can prevent a longitudinal displacement of the mounting device 1 by engaging in a corresponding recess 4 of the guide element 3. The selector recess 19 and/or the detent 17 are preferably designed complementary in shape to the selector knob 11 or the resting protrusion 12. This makes it possible for the selector knob 11 and/or the resting protrusion 12 to be at least partially received in the device housing 5 and thus to protrude just a little or not at all from its surface. At the same time, the proposed construction makes it possible for accidental locking or unlocking to be relatively unlikely. In addition, the locked state is clearly visible and can even be felt in the dark, as can be determined relatively easily by the protruding bearing knob 16 or the latched resting protrusion 12.

In FIGS. 4-7 different embodiments can be seen which primarily show the possibilities of different locking protrusions 15. FIGS. 4-7 are each structured analogously, in that the installation process can be seen from right to left and the locking status can be seen in the left column. In the top row (in each case Fig. XXA), each top view is shown in the z direction. In the middle row (in each case Fig. XXB), sectional views B-B' of the spindle axis 9 corresponding to the plan views can be seen. Sectional views C-C' and D-D' through the center plane of the mounting device 1 on the guide element 3 of a firearm are shown schematically in the respective lower image section (Fig. XXC), as becomes clear when looking at FIG. 2. FIGS. 4C and 5D correspond to FIG. 2A and FIGS. 6C and 7C with FIG. 2B.

Figure 4A:
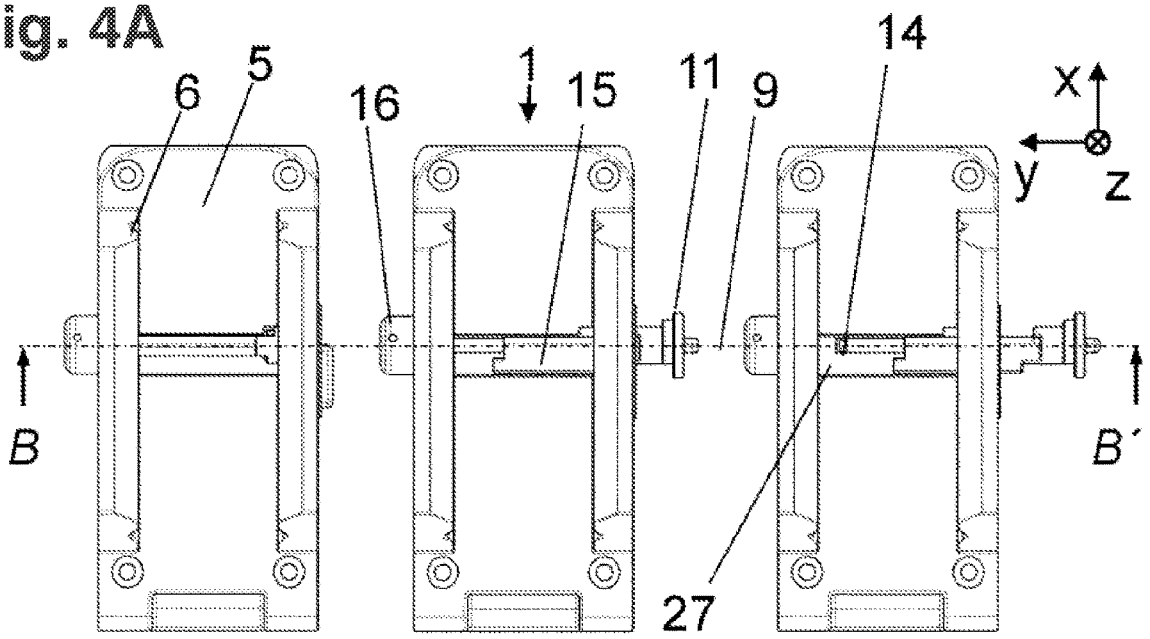
FIGS. 4A-4C depict a mounting device according to the present disclosure.
Figure 4B:
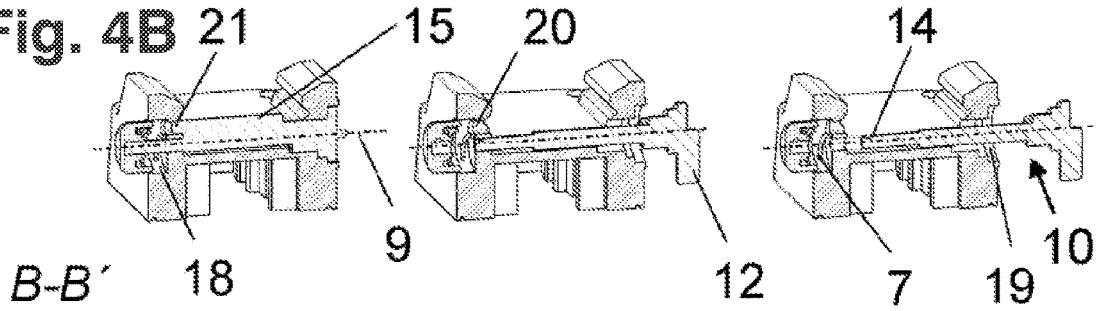
Figure 4C:
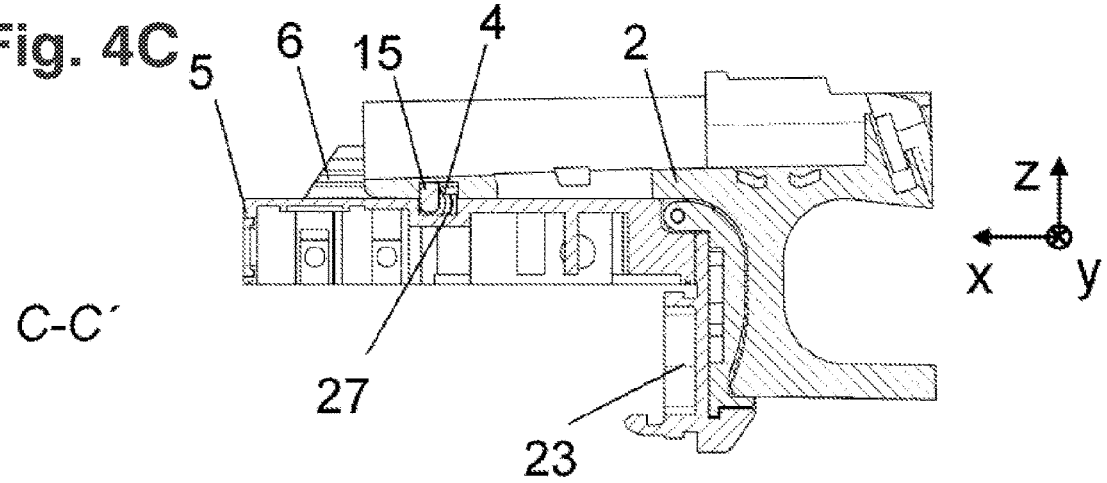

A possible embodiment is shown in FIG. 4, the locking protrusion 15 in the center part 13 being formed on one side of the locking spindle 10. In the right and middle illustration of FIG. 4A, the locking spindle 10 is inserted into the device housing 5, as can be seen very clearly in section in the illustrations below in FIG. 4B. The locking protrusion 15 can be inserted in such a way that it is "pivoted in" within the recess 27. If the locking spindle 10 is rotated into the working position, that is to say the locked state (see FIG. 4A), the resting protrusion 12 can engage in the detent 17 as described above, and the locking protrusion 15 is "up," i.e. "pivoted out" of the recess 27, and is accordingly in engagement with a recess 4. This state is shown for comparison in FIG. 4C in which the contact of the locking protrusion 15 against the sidewall of the recess 4 can be clearly seen. In the embodiment shown, the accessory 8 is supported by the accessory housing 23 with respect to the receiver 2 and is thus attached to the firearm.

The mounting device 1 can thus be supported in the longitudinal direction of the guide 6 with respect to a receiver 2 and can thus be mounted without play on a firearm. The mounting device 1 can also be designed in such a way that the support is accomplished via the guide element 3 by engaging in one or more recesses, as will be explained later. A person skilled in the art can also minimize the clearance in the vertical direction by suitable adaptation of the guide 6 in relation to the guide elements 3 of a firearm.

Figure 6A:
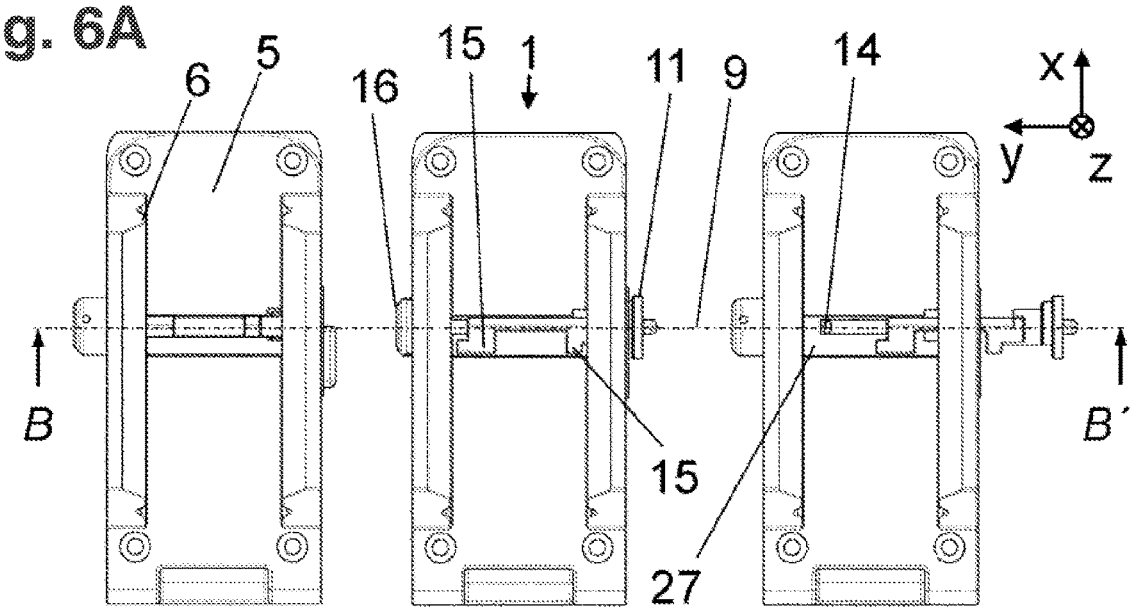
FIGS. 6A-6C depict a mounting device according to the present disclosure.
Figure 6B:
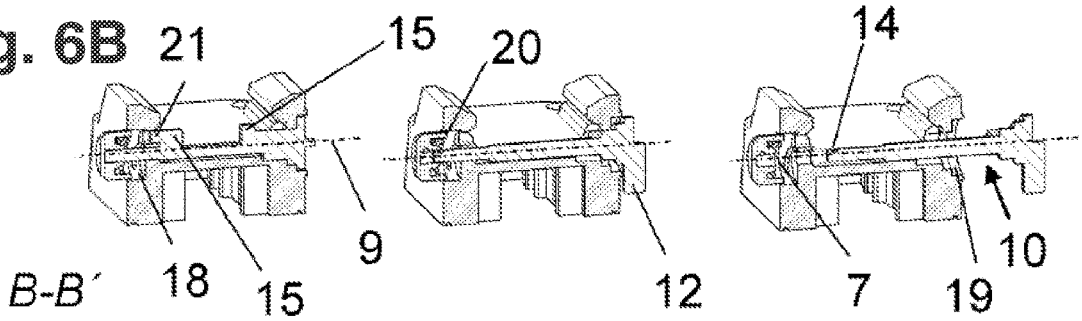
Figure 6C:
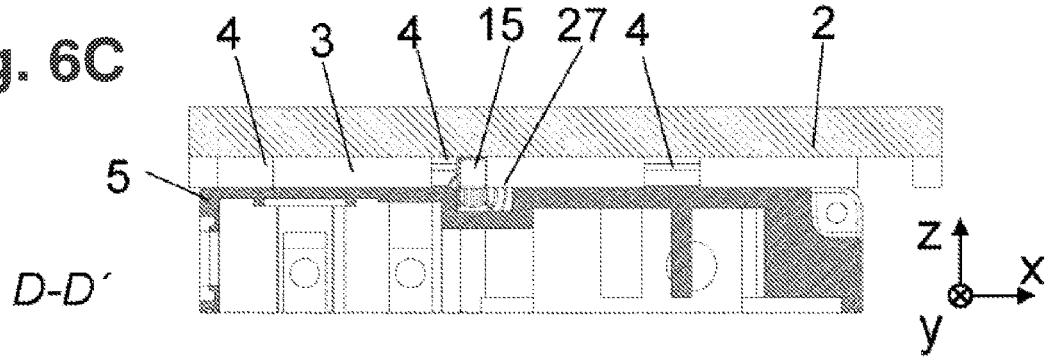

Another possible embodiment can also be seen in FIG. 4 and particularly clearly in FIG. 6, according to which at least one locking protrusion 15 has a cantilever 21 in the direction of the bearing knob 16. This cantilever 21 serves, in the locking position, to engage in a secondary locking recess 20 arranged parallel to the spindle axis 9 on the device housing 5. The cantilever 21 additionally supports the locking spindle 10 in the locking state within the device housing 5, after which an improved load transfer and relief of the bearing points of the locking spindle 10 can be achieved, as can be seen particularly well in FIG. 6B.

Figure 5A:
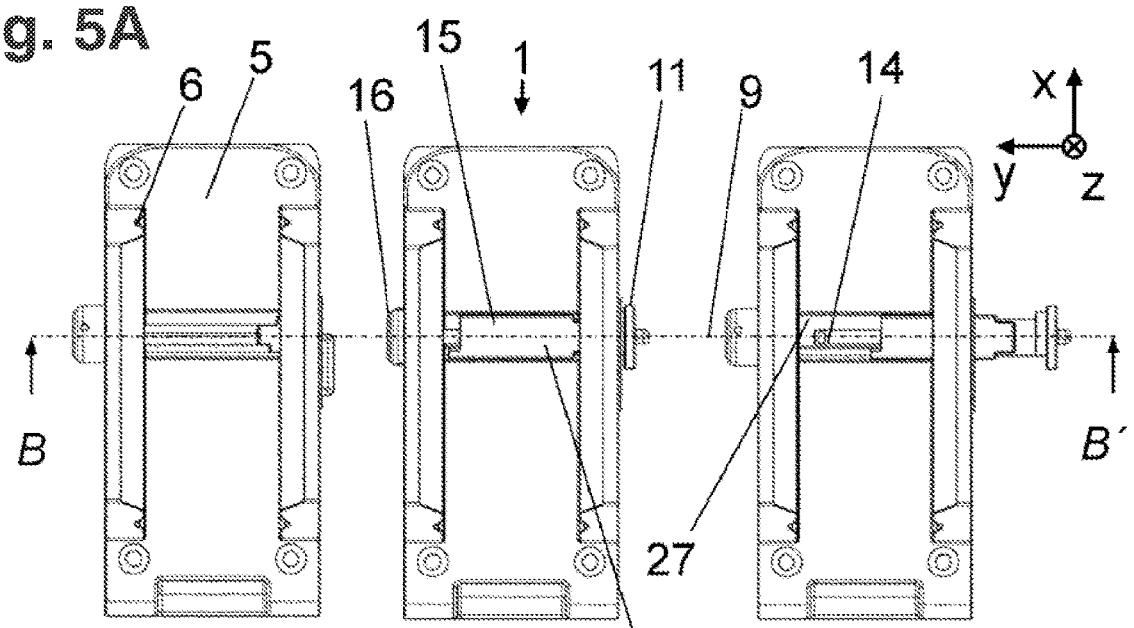
FIGS. 5A-5C depict a mounting device according to the present disclosure.
Figure 5B:
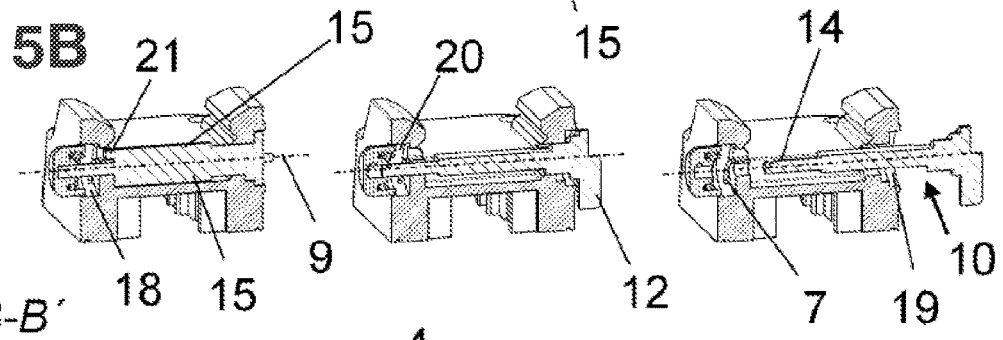
Figure 5C:
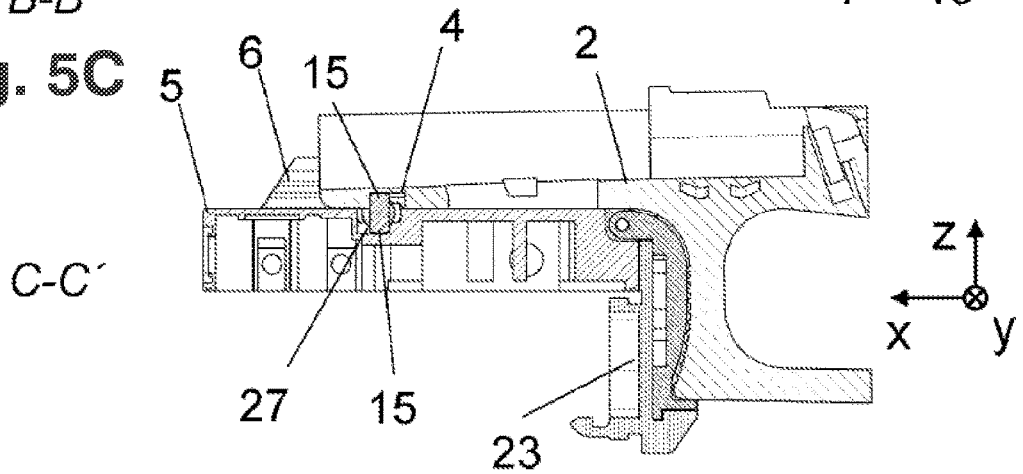

FIG. 5 shows a further possible embodiment of a locking spindle 10 with locking protrusions 15 protruding on both sides. The description of FIGS. 4*a* and *b* can be applied mutatis mutandis. However, it should be emphasized that, in comparison to the one-sided locking protrusion 15 of FIG. 4, the two-sided design of the two locking protrusions 15 provides additional support for the locking spindle 10 on the device housing 5, see FIG. 4*c*. In the locking position, the "upper" locking protrusion 15 presses in the x direction against the receiver 2 on the sidewall of the recess 4, while the "lower" locking protrusion 15 on the device housing 5 engages the sidewall of the recess 27. This can relieve the pivot points of the locking spindle 10 within the device housing 5.

Another possible embodiment of a locking spindle 10 is shown schematically in FIG. 6. The description of FIGS. 4A and 4B can be applied mutatis mutandis, the locking protrusion 15 formed on one side in the shown example of FIG. 6 being interrupted in the longitudinal direction of the locking spindle 10 or being formed as two locking protrusions 15 spaced apart from one another along the spindle axis 9. This embodiment is particularly suitable for Picatinny rails having a central longitudinal groove, since the two locking protrusions 15 press against the Picatinny rail in the locked state and the longitudinal groove remains free. For this reason, the locking protrusion 15 is also located behind the sectional plane in FIG. 5C, in the sectional view D-D'; the function is otherwise as described for FIG. 4C.

Figure 7A:
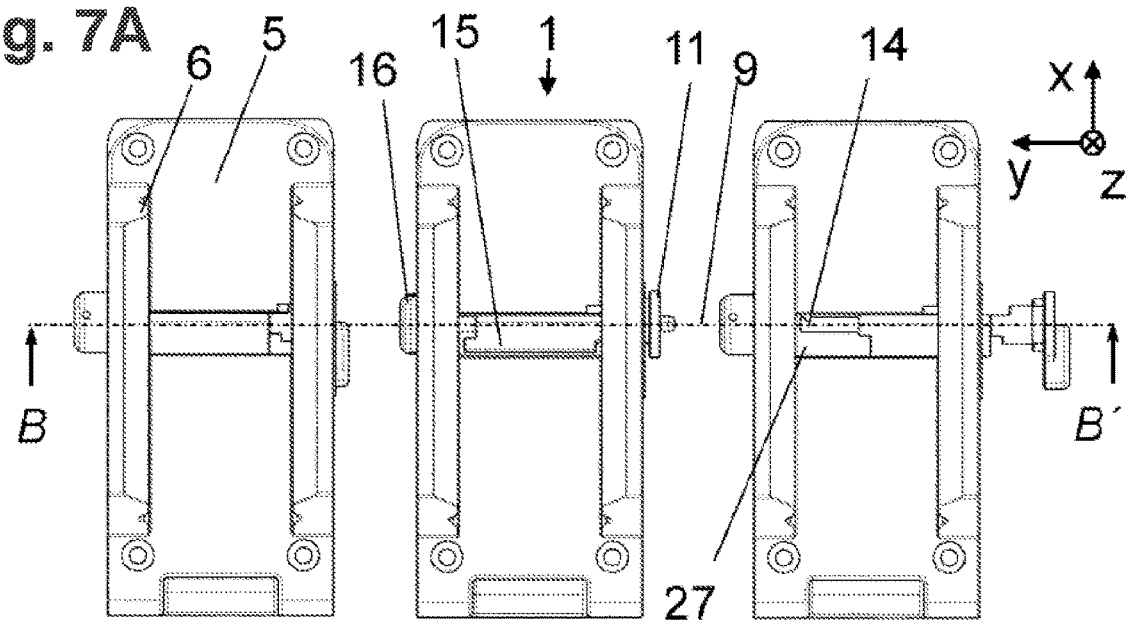
FIGS. 7A-7C depict a mounting device according to the present disclosure.
Figure 7B:
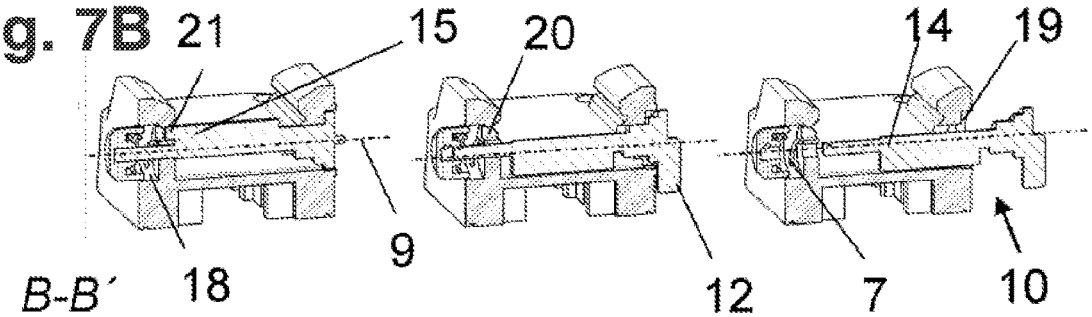
Figure 7C:
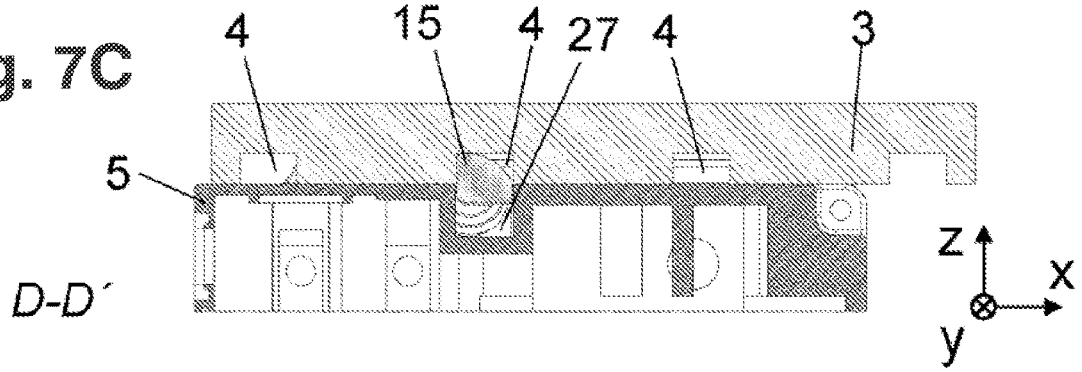

Another possible embodiment is shown in FIG. 7, in which the locking protrusion 15 has the cross-sectional shape of a segment of a circle, as can be seen particularly well in FIG. 7C. The installation and the function are carried out in the same way as the aforementioned versions.

Generally speaking, it is thus possible to form the locking protrusion 15 in at least one further spatial direction, preferably diametrically opposite normal to the spindle axis 9, as is the case, for example, with the cross-sectional shape of a wave shape or S shape. The embodiment with two locking protrusions 15 (FIG. 5) is also to be understood as falling into this category.

The special embodiment of the locking protrusion 15 in the form of a segment of a circle in FIG. 7 allows an additional support surface on the device housing 5 with suitable coordination with the dimensions of the recesses 4 and thus improves the introduction of force into the receiver 2, which in turn relieves the bearing points of the device housing 5, as is also the case with the "two-wing" version in FIG. 5.

All previous embodiments can also be directly transferred analogously to the following embodiments with two or more locking spindles 10.

In FIGS. 8 to 11, possible embodiments for mounting devices 1 with two locking spindles 10 are described below, but three or more locking spindles 10 acting in an analogous manner are also conceivable in a mounting device 1.

Figure 8A:
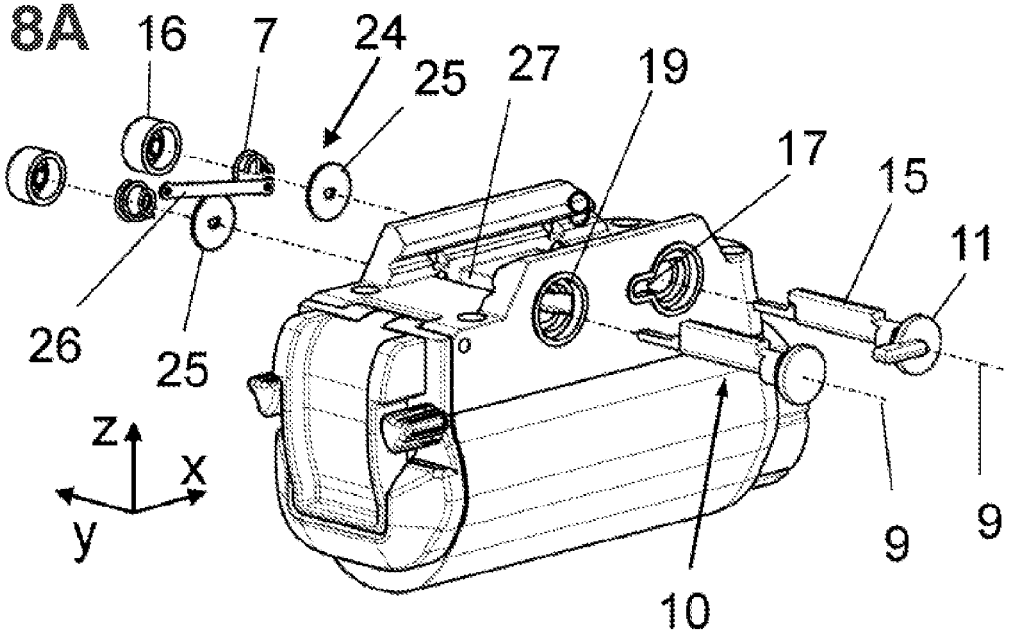
FIGS. 8A and 8B schematically show an illustrative mounting device according to the present disclosure having two locking spindles and a coupling device in two oblique views.
Figure 8B:
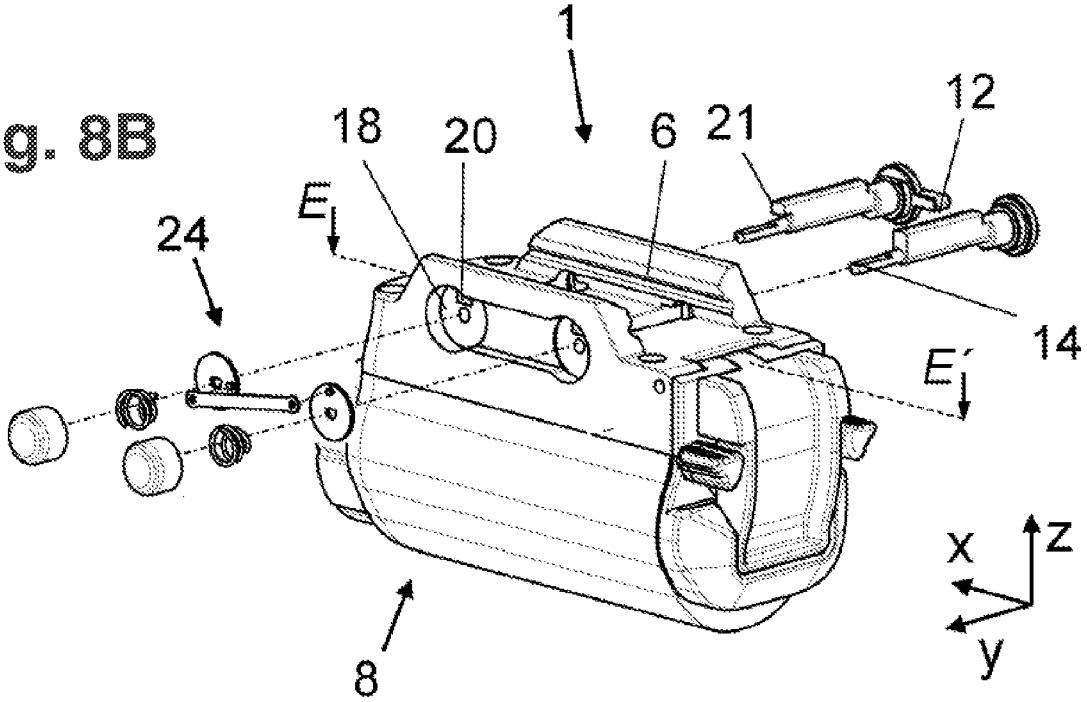

In each of FIGS. 8A and 8B are two perspective exploded views of an accessory 8 having a mounted mounting device 1, shown schematically. In FIG. 8A the "right" side with two selector recesses 19 can be seen, in which recesses the selector knobs 11 can be accommodated after the locking spindles 10 have been inserted. In this embodiment, only one of the selector knobs 11 has a resting protrusion 12, which is designed to interact with the detent 17—mutatis mutandis with respect to the preceding description. The two locking spindles 10 are, however, designed to be actuated together by only one of the locking spindles 10 being actuated, in practice the one with the resting protrusion 12. The two locking spindles 10 are connected via a coupling device 24, as can be seen very clearly in conjunction with FIG. 8B.

The coupling device 24 comprises two disks 25 and a coupling rod 26, the disks 25 in the installed state each being assigned to a corresponding locking spindle 10 and being connected thereto, preferably detachably, and the coupling rod 26 connecting the two disks 25 to one another. The connection of the disks 25 to the locking spindle 10 can be accomplished, for example, using a plug-in connection with a profile of complementary shape, as can be seen very clearly from FIG. 8. The connection of the disks 25 to the coupling rod 26 is also preferably formed via a plug-in connection, the disks 25 having small connecting projections for the coupling rod 26, as can be seen in FIG. 8B. In order for the coupling device 24 to be able to move within the limits described above in the installed state and for the coupling device 24 to not protrude past the surface of the device housing 5, it is advantageous to provide bearing recesses 18 having a continuous connection to one another on the device housing 5.

The advantage of such a coupling device 24 is primarily that it only has to rotate a locking spindle 10 and still unlock or lock the entire mounting device 1.

Figure 9A:
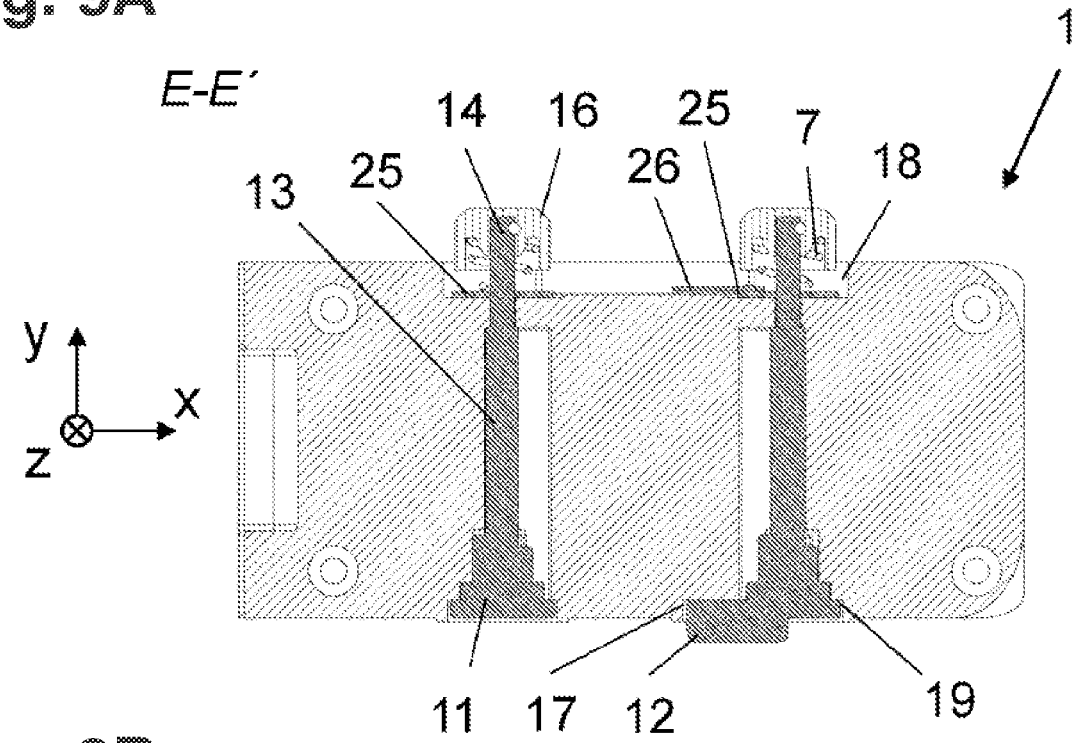
FIGS. 9A and 9B are a cross-section views through the spindle axis of the mounting device along E-E' of FIG. 8B.
Figure 9B:
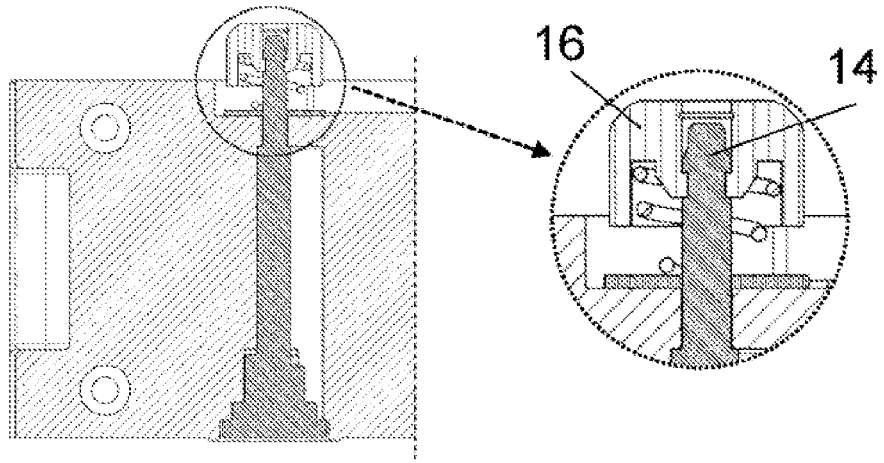
Figure 9C:
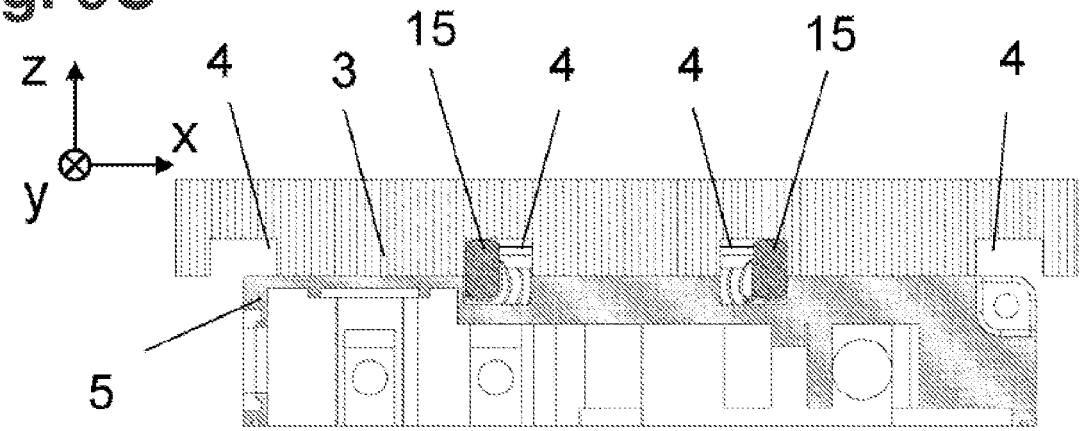
FIG. 9C shows a sectional view in the y-direction through the central plane of the mounting device of FIG. 8B.

The installation state can be seen very clearly in FIG. 9, which shows a sectional view E-E' in the z direction from "above" at the level of the spindle axis 9 (FIG. 9A). Analogously to the aforementioned embodiments, the locking spindle 10 can be shifted slightly along the spindle axis 9 and rotated about it in the release position. FIG. 9C schematically shows the engagement situation of the locking protrusions 15 in two recesses 4 of a guide element 3 with opposite movement from the rest position into the working position or locking position, as would occur corresponding to the embodiment in FIGS. 8 and 9A. This sectional view is shown analogously to FIGS. 4C-7C on the spindle axis 9. This particular connection of the two locking spindles 10 allows the mounting device 1 to be supported on both sides only on the guide element 3.

FIG. 9B shows a sectional view corresponding to FIG. 9A, the connection piece 14 being designed as a non-detachable plug-in connection. The embodiment is illustrated in the associated detail view. The connection piece 14 has a widening and a notch in which a protrusion of the otherwise hollow bearing knob 16 can engage. It is immediately clear to a person skilled in the art that a reverse arrangement can also be implemented. A hollow locking spindle 10 or connection piece 14 would be formed therein, for example, and the corresponding bearing knob 16 would have a pin-shaped or mushroom-shaped extension on its inside. It is also clear to a person skilled in the art that these extensions, notches, etc. do not necessarily have to be formed around the entire circumference in order to achieve the desired mounting.

Likewise, although not shown, a person skilled in the art can relatively easily design the coupling device 24 in a suitable manner in order to cause the two locking spindles 10 to rotate in the same direction of rotation. This measure can reduce the local surface pressure of the locking protrusions 15 on the sidewall of the respective recess 4 or on the bearing points of the locking spindles 10.

Furthermore, variants of the mounting device of the present disclosure are not shown in which a second detent 17 is provided on the device housing 5 in such a way that the locking spindle 10 can also be pivoted "in the opposite direction." The recess 27 should advantageously be wide enough that the locking protrusion 15 can be pivoted in the "opposite direction." Such an embodiment is particularly advantageous in combination with two locking protrusions 15, which are formed on both sides of the locking spindle 10, since the mounting device 1 is used both "forward" and "backward" when viewed in the longitudinal direction of the guide 6. This largely corresponds to the idea of a "two-sided" design, since the accessory 8 can thus be attached to the firearm in both directions. Of course, these variants can be combined with all of the embodiments described above.

Figure 10A:
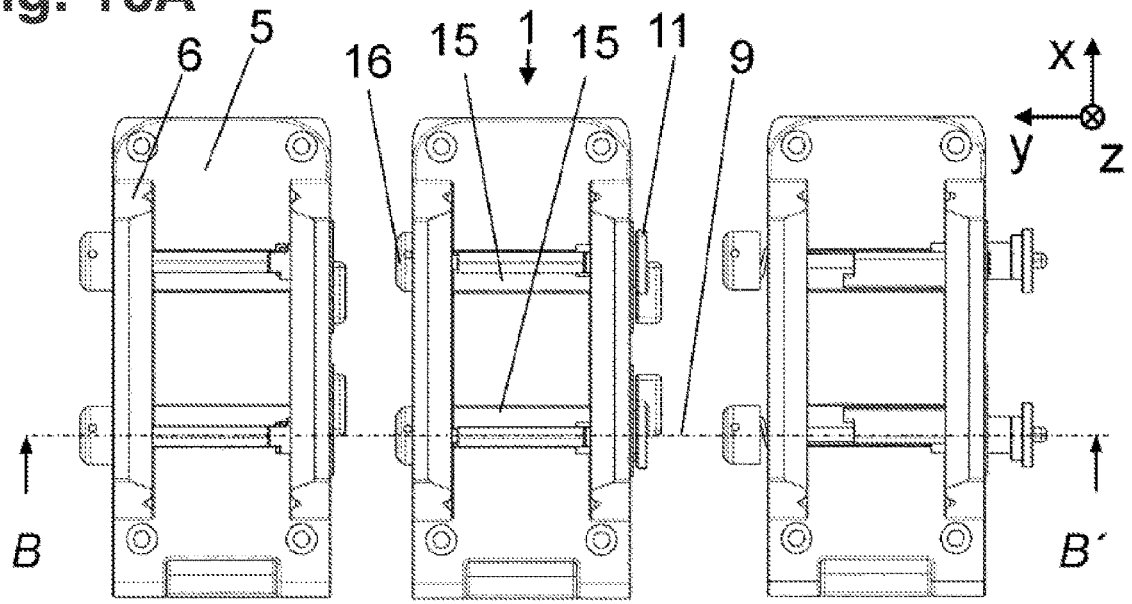
FIGS. 10A-10C depict a mounting device according to the present disclosure having two locking spindles.
Figure 10B:
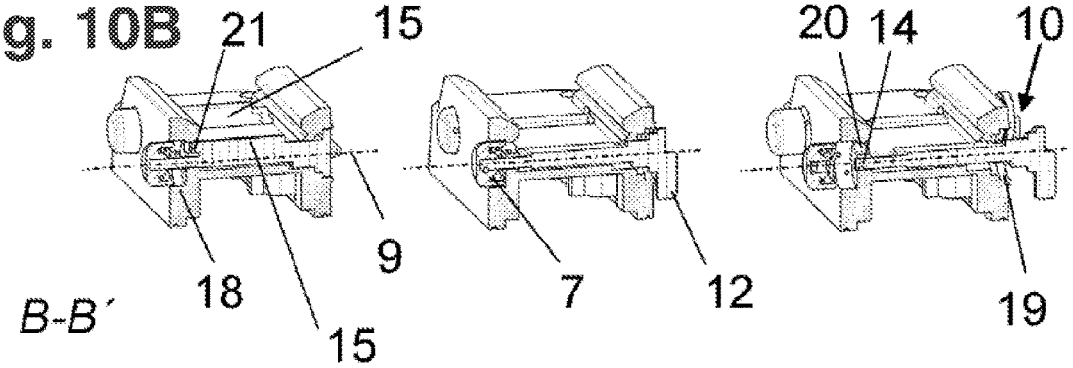
Figure 10C:
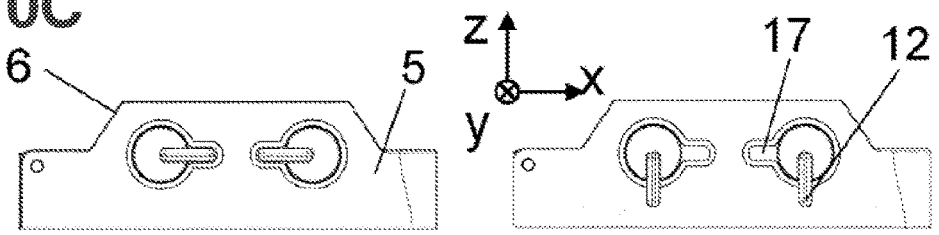

In FIG. 10 a further embodiment is depicted which shows a mounting device 1 having two independently acting and operable locking spindles 10; see in particular FIG. 10C. In the chosen example, the directions of rotation of the locking spindles 10 are provided in opposite directions, the function being analogous to the previous description of FIGS. 4-7 and a detailed description being dispensed with at this point. The support on the guide element 3 is therefore carried out analogously to the sectional view in FIG. 9C. The two resting protrusions 12 are each assigned here a corresponding detent 17, which are "aligned with one another." In this way, two identical locking spindles 10 can be used; alternatively, the alignment of the detents 17 in the same direction would also be possible, provided that the alignment and/or number and/or shape of the locking protrusions 15 are designed as desired according to the preceding description.

A further possible independent embodiment is shown in FIG. 11 which can be combined with all of the preceding embodiments. In the example shown, the device housing 5 has at least one taper 22 for self-centering and locking the resting protrusion 12 in the locking position. The taper 22 represents a bevel or else a ramp and is designed to rise outward in such a way that the resting protrusion 12 is guided into the detent 17 when it is rotated into the locking position along the taper 22. For a better understanding, a sectional axis F-F' is drawn in the perspective view in FIG.

11A and extends "in front of" the spindle axis 9 in the x direction. The two representations on the right represent the corresponding cross-sectional views of the plane F-F' in the x-direction. Especially when viewed together with the locking position in FIG. 11B, the course and the positioning of the taper 22 or the resting protrusion 12 become clear.

Such a taper 22 can also or alternatively be provided for self-centering of a cantilever 21 on the locking protrusion 15 in the secondary locking recess 20. In general, a taper 22 can make it easier to snap into the locking position due to the spring pretensioning and, in borderline cases, even cause self-centering or self-locking when the selector knob 11 is released. The taper 22 can correspondingly also be formed on the device housing 5 on the inside of the guides 6.

Thus, by adapting the type, shape, number and design of the locking spindles 10, the locking protrusions 15, the springs 7, and the device housing 5, etc., an optimization for the respective application can be made in a relatively simple manner by a person skilled in the art. In addition, the outer dimensions and interfering contours can be reduced by suitable measures, such as the provision of bearing 18 and/or selector knob recesses 19. Furthermore, with the present disclosure it is possible to design the mounting device 1 in such a way that it can be mounted along the guides 6 in two directions, that is to say also "in reverse." In addition, a self-locking function can be implemented in a relatively simple and user-friendly manner by means of tapers 22.

As mentioned above, the present disclosure also extends to all types of accessories 8, in particular tactical lights, lasers, red dot or similar sighting devices, as well as silencers which have a mounting device according to any of the preceding embodiments. The device housing 5 of the mounting device 1 can be formed integrally with the accessory housing 23, whereby a particularly high stability and reduced assembly effort can be achieved.

The present disclosure is not limited to the illustrated and described embodiments, but can be modified and configured in various ways. In particular, the shown cross-sectional shapes of the aforementioned receiver parts, pins, rails, recesses, etc. can be adapted to the given basic data, and the lengths and the positions with respect to the receiver can also be easily adapted by a person skilled in the art having knowledge of the present disclosure. The variants shown and described in the individual embodiments can be combined as required.

In the description and the claims, the terms "front," "rear," "above," "below" and so on are used in the generally accepted form and with reference to the object in its usual position of use. This means that in a weapon the muzzle of the barrel is "at the front," that the slide is moved "backward" by the explosive gas, etc. Transverse to a direction essentially means a direction turned 90° thereto.

It should also be noted that in the description and the claims, terms such as the "lower region" of an object refer to the lower half and in particular the lower quarter of the overall height; "lowermost region" refers to the lowermost quarter and in particular an even smaller part, while "central region" refers to the central third of the overall height. For the terms "width" or "length," this applies mutatis mutandis. All these terms have their generally accepted meaning, applied to the intended position of the object under consideration.

In the description and the claims, "substantially" means a deviation of up to 10% of the stated value, if physically possible, both downward and upward, otherwise only in the appropriate direction; in the case of degrees (angle and temperature), this means ±10°. If there are terms such as "substantially constant" etc., what is meant is the technical possibility of deviation which a person skilled in the art takes as a basis and not the mathematical one. For example, a "substantially L-shaped cross-section" comprises two elongated surfaces, which each merge at one end into the end of the other surface, and whose longitudinal extension is arranged at an angle of 45° to 120° to one another.

All given quantities and percentages, in particular those relating to the limitation of the present disclosure, insofar as they do not relate to specific examples, are understood to have a tolerance of ±10%; accordingly, for example: 11% means: from 9.9% to 12.1%. With terms such as "a guide," the word "a" is not to be considered as representing a singular numeral, but rather is to be considered an indefinite article or pronoun, unless the context indicates otherwise.

Unless otherwise stated, the term "combination" or "combinations" mean all types of combinations, starting from two of the relevant components up to a plurality or all of such components; the term "containing" also means "consisting of."

The features and variants stated in the individual embodiments and examples can easily be combined with those of the other examples and embodiments and in particular can be used for characterizing the invention in the claims without necessarily including the other details of the particular embodiment or of the particular example.

LIST OF REFERENCE NUMBERS WITH STANDARD ENGLISH TRANSLATIONS:

1 Mounting device
2 Receiver
3 Guide element(s)
4 Recess
5 Device housing
6 Guide or guide rail
7 Spring
8 Accessory
9 Spindle axis
10 Locking spindle
11 Selector knob
12 Resting protrusion
13 Center portion or center part
14 Connection piece
15 Locking protrusion
16 Bearing knob
17 Detent or rest
18 Bearing recess
19 Selector recess
20 Secondary locking recess
21 Cantilever
22 Taper
23 Accessory housing
24 Coupling device
25 Disk(s)
26 Coupling rod
27 Recess

The invention claimed is:

1. A mounting device for accessories on a firearm having a barrel axis, where the firearm has guide elements substantially parallel to the barrel axis, and at least one recess formed transversely to the barrel axis, the mounting device comprising:

a device housing having guides configured to interact with the guide elements;

a spring;

at least one bearing knob;

at least one locking spindle having a spindle axis, the locking spindle being configured to interact with the bearing knob and the recess;

the locking spindle having a first end, a center part, and a second end; where the first end includes a selector knob with a resting protrusion, the center part has at least one locking protrusion formed in a spatial direction normal to the spindle axis, and the second end includes a connection piece;

the locking spindle being disposed in the device housing so that the locking spindle is rotatably and/or longitudinally displaceable;

wherein the mounting device is configured so that:

the mounting device can be placed in an open position by a displacement of at least the resting protrusion of the selector knob along the spindle axis, bringing the resting protrusion out of engagement with a detent formed on a side of the device housing, where the detent is complementary in shape to the resting protrusion, thereby enabling a rotation of the locking spindle;

the rotation of the locking spindle can disengage the locking protrusion from the recess, thereby enabling a displacement of the mounting device along the guide elements; and the mounting device can be mounted on the firearm in a locking position by bringing the locking protrusion into engagement with the recess and engaging at least the resting protrusion of the selector knob partially or completely with the detent, thereby locking the mounting device in place.

2. The mounting device according to claim 1, wherein the spring is arranged between the device housing and the bearing knob, and is configured to pretension the locking spindle in a direction of the bearing knob.

3. The mounting device according to claim 1, wherein the device housing defines at least one of a bearing recess designed to at least partially receive the bearing knob or a selector recess designed to at least partially receive the selector knob, where the bearing recess and the selector recess are arranged laterally on the device housing.

4. The mounting device according to claim 1, wherein the connection piece is detachably connected by a threaded connection and/or a plug-in connection, or non-detachably connected by a plug-in connection.

5. The mounting device according to claim 1, the guides of the device housing are complementary in shape to a dovetail guide element.

6. The mounting device according to claim 5, wherein the dovetail guide element includes a Picatinny rail.

7. The mounting device according to claim 1, wherein the at least one locking protrusion includes a cantilever extending in a direction of the bearing knob, the cantilever being configured to engage in a secondary locking recess that is arranged parallel to the spindle axis on the device housing when in the locking position.

8. The mounting device according to claim 1, further comprising at least one taper formed on the device housing.

9. The mounting device according to claim 1, comprising two locking protrusions formed spaced apart from one another along the spindle axis.

10. The mounting device according to claim 1, wherein the locking protrusion is formed normal to the spindle axis in at least one further spatial direction.

11. The mounting device according to claim 10, wherein the locking protrusion is formed diametrically opposite normal to the spindle axis.

12. The mounting device according to claim 1, wherein the mounting device comprises at least two locking spindles.

13. The mounting device according to claim 12, wherein the at least two locking spindles can be deflected in opposite directions, and are arranged at two recesses so as to support locking protrusions on both sides.

14. The mounting device according to claim 12, wherein the at least two locking spindles are connected by a coupling device.

15. An accessory for a firearm, comprising a mounting device according to claim 1, wherein the device housing of the mounting device is integrally formed with an accessory housing.

16. The accessory for a firearm according to claim 15, wherein the accessory includes a tactical light, a laser, a red dot, or a silencer.

* * * * *